US006454194B1

(12) United States Patent
Hamada et al.

(10) Patent No.: US 6,454,194 B1
(45) Date of Patent: Sep. 24, 2002

(54) GRANULAR MATERIAL PROCESSING APPARATUS

(75) Inventors: Kenji Hamada; Shinichi Yamamoto; Yoshihiro Wakamatsu, all of Tokyo (JP)

(73) Assignee: Nara Machinery Co., Ltd., Tokyo (JP)

( * ) Notice: Subject to any disclaimer, the term of this patent is extended or adjusted under 35 U.S.C. 154(b) by 19 days.

(21) Appl. No.: 09/695,393

(22) Filed: Oct. 23, 2000

(30) Foreign Application Priority Data

Feb. 22, 1999 (JP) ..... 11-43238

(51) Int. Cl.[7] ..... B02C 15/10
(52) U.S. Cl. ..... 241/120; 241/131
(58) Field of Search ..... 241/117, 131, 241/176, 120, 130

(56) References Cited

U.S. PATENT DOCUMENTS 3,840,190 A 10/1974 Consoli
3,910,509 A 10/1975 Eirich
5,373,996 A * 12/1994 Hamada ..... 241/126

FOREIGN PATENT DOCUMENTS

JP 14-13787 9/1939
JP 5236305 8/1977
JP 8-155321 6/1996

* cited by examiner

*Primary Examiner*—Mark Rosenbaum
(74) *Attorney, Agent, or Firm*—Christensen O'Connor Johnson Kindness PLLC

(57) ABSTRACT

The object is that of providing a granular material processing apparatus (1) capable of evenly applying energy such as the compressive force and shearing force of pressers (5), due to centrifugal force, while maintaining good circulation conditions for the swirl flow of granular material within a casing (3) wherein, even in cases where granular material for which it is difficult to control the flow thereof in the casing (3) is processed, this is not allowed to accumulate in once place within the casing (3), but is moved to the entire interior wall thereof. In the cylindrical region formed in accordance with the revolution of the pressers (5) in the casing (3), an empty region (6) is formed wherein there is no extension of a shaft (201) etc., allowing for the formation of a center of swirl flow of the granular material; the rotation of the casing (3) and the rotation of a rotor (4) can be rotationally controlled in the same direction at differing speeds; and the pressers (5) are horizontally supported in a cantilevered manner on the rotor (4).

38 Claims, 3 Drawing Sheets

(a)

(b)

(c)

GRANULAR MATERIAL PROCESSING APPARATUS

CROSS-REFERENCE TO RELATED APPLICATIONS

This is a United States national stage application under 35 U.S.C. § 371 of International Application PCT/JP00/00919, which designates the United States, with an International filing date of Feb. 18, 2000, published under PCT Article 21(2) as International Publication No. WO00/50174 on Aug. 31, 2000, the benefit of the filing data of which is hereby claimed under 35 U.S.C. § 120, which in turn claims the benefit of Japanese Application No. 11/43238, filed Feb. 22, 1999, the benefit of the filing date of which is hereby claimed under 35 U.S.C. § 119.

TECHNICAL FIELD

The present invention relates to a granular material processing apparatus, and more particularly, to an apparatus which can be used in pulverizing granular materials, in mixing granular materials and liquids, and to evenly disperse such slurry substances as pigments and paints, etc.

BACKGROUND ART

In general, this type of granular material processing apparatus, such as, for example, pulverizing apparatus and mixing and dispersion apparatus are such that a plurality of pressers are arranged on a rotor within a cylindrical casing, the pressers press against the inner wall of the casing due to centrifugal force, material to be processed which comes between the pressers and the inner wall of the casing is trapped, and such processing as pulverization is performed. At this point, it is necessary that the material to be processed is uniformly moved to the entire inner wall of the casing, without becoming immobilized in one place within the casing.

The present applicants have proposed an apparatus wherein, so as to evenly move the material to be processed to the entire inner wall of the casing, the pressers comprise a columnar plurality of ring members consecutively positioned in close contact with each other (Japanese Unexamined Patent Bulletin 6-79192, and equivalent U.S. Pat. No. 5,373,996) whereby various granular material processing, such as fine pulverization of solid substances in a short time, can be performed efficiently and in a short period of time.

However, in cases where, for example, the material to be processed is dry pulverized, the movement of the material to be processed within the casing is extremely poor and the material to be processed has physical properties whereby it readily accumulates in one place within the casing. For this reason, by rotating the pressers at high speeds, while stirring the particulate matter, centrifugal force is applied, moving it in the peripheral direction, so as to control the movement of the material to be processed. However, in the cylindrical region formed in accordance with the revolution of the pressers, a shaft is extended in order to support both ends of the pressers, and if the speed of rotation is too great, centrifugal force increases and the swirl flow of the material to be processed within the casing is greatly disturbed. Consequently, particularly in cases of powders having low specific gravity or small processing quantities, the granular material becomes immobilized at the top, and there is a problem in so much as it is difficult to evenly apply pulverization energy in the form of the compressive force and shearing force of the pressers. This is also true in cases where small amounts of granular materials are wet processed.

Accordingly, with an apparatus wherein processing of granular materials is dependent on the rotation of the pressers alone, due to considerations of the swirl flow etc., it is not possible to perform various processing such as pulverization while optimally controlling the movement of various granular materials (even distribution).

The present invention is a novel idea intended to eliminate the problems, wherein the granular material, the movement of which within the casing is difficult to control, is moved to the entire inner wall of the casing without accumulating at one place within the casing, and such presser energy as compressive force and shearing force due to centrifugal force can be evenly applied, allowing for processing under good conditions. Thus, the movement of the granular material is controlled and, while the granular material is evenly distributed, presser energy such as compressive force and shearing force is applied to the granular material, providing an environment within the casing wherein various types of processing such as pulverization are optimized in terms of effectiveness.

DISCLOSURE OF THE INVENTION

A technical means employed by the present invention in order to solve the problems is an apparatus wherein a rotor coupled to a shaft is provided within a casing which forms a granular material processing chamber, a plurality of pressers are supported around the rotor at the edge thereof separated from each other by a predetermined gap, the pressers are caused to revolve in cooperation with the rotation of the rotor, and press against the inner wall of the casing to process a granular material, characterized in that, in the cylindrical region formed in accordance with the rotation of the pressers, an empty region is formed wherein there is no extension of the shaft etc., allowing for the formation of a center of swirl flow of the granular material within the cylindrical region.

Another technical means employed by the present invention is an apparatus wherein a casing which forms a granular material processing chamber and a rotor provided within the casing are each coupled to shafts and rotatable therewith, a plurality of pressers are supported around the rotor at the edge thereof separated from each other by a predetermined gap, the pressers are caused to revolve in cooperation with the rotation of the rotor, and press against the inner wall of the casing to process a granular material, characterized in that the rotation of the casing and the rotation of the rotor are rotationally controlled in the same direction at different speeds of rotation.

Another technical means employed by the invention is an apparatus wherein a casing which forms a granular material processing chamber and a rotor provided within the casing are each coupled to shafts and rotatable therewith, a plurality of pressers are supported around the rotor at the edge thereof separated from each other by a predetermined gap, the pressers are caused to revolve in cooperation with the rotation of the rotor, and press against the inner wall of the casing to process a granular material, characterized in that the pressers are supported in a cantilevered manner on the rotor so that the axis of rotation of the apparatus is horizontally oriented, and a horizontally oriented cylindrical region is formed in accordance with the rotation of the pressers.

BEST MODE FOR CARRYING OUT THE INVENTION

In the following a mode for carrying out the invention will be described in detail as the preferred mode of embodiment based on an example of a granular material processing apparatus.

Figure 1:
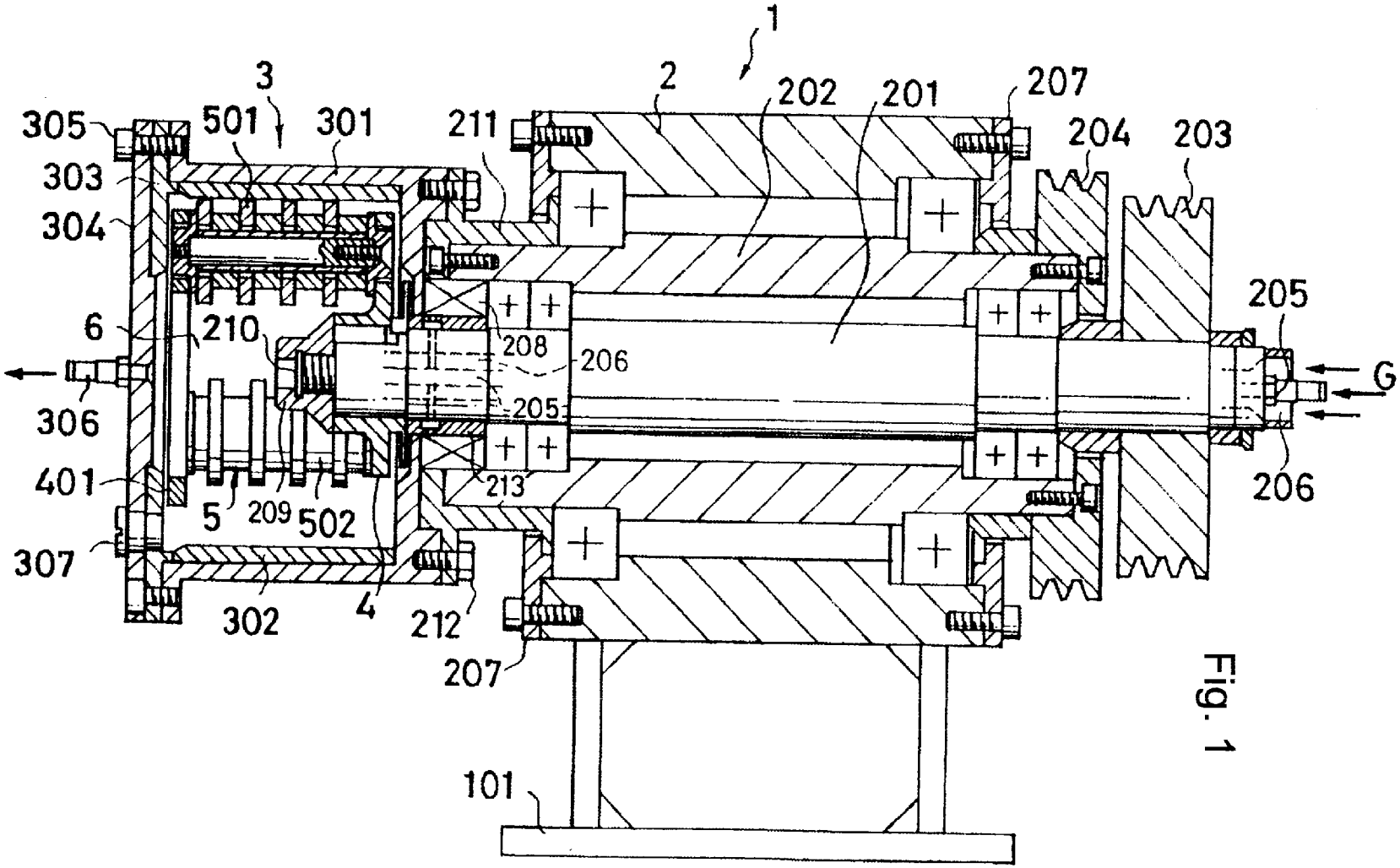
FIG. 1 is an overall sectional view of a granular material processing apparatus.
Figure 2:
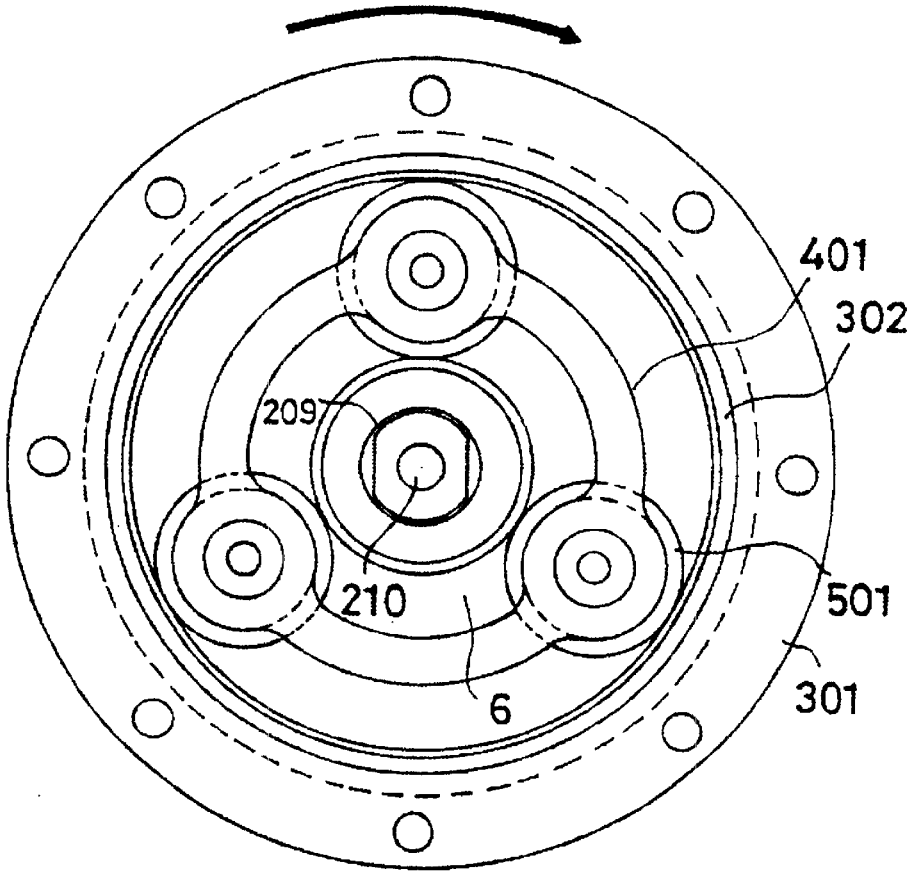
FIG. 2 is a side view of a granular material processing apparatus from which the front cover has been removed.
Figure 3:
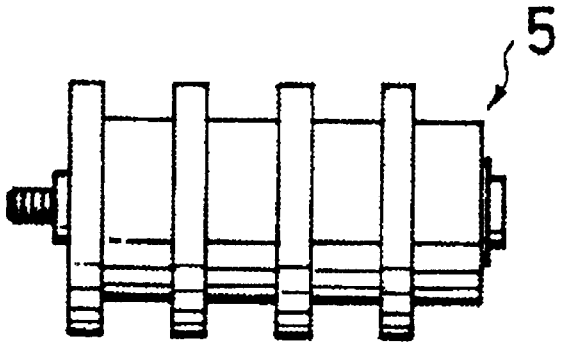
FIG. 3 is an explanatory diagram of the configuration of pulverizing rings on pressers.
Figure 3:
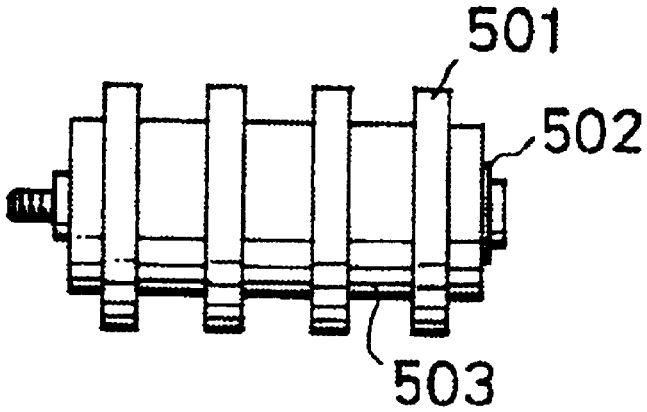
Figure 3:
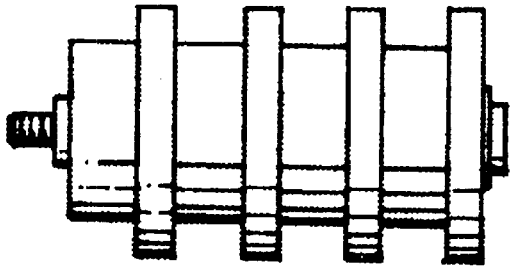

In FIGS. 1 to 3, a granular material processing apparatus 1 provided on a stand 101 is composed of a housing 2 mounted on a stand 101, and a casing 3 which forms a granular material processing chamber. In the housing 2, a main shaft 201 and a sub-shaft 202, in which the main shaft 201 has been inserted so that it is contained therein, are fitted together so as to be integrated and constitute a so-called double shaft mechanism. Within the main shaft 201 a gas supply pipe 205 which supplies shaft seal gas G (in case of continuous processing, a carrier gas is combined with this) and a material supply tube 206, for cases where the processing material is continuously supplied, are each fitted so as to form a double tube structure.

At one end of each of the shafts 201 and 202, are provided pulleys 203 and 204, which are coupled to a drive mechanism not shown in the drawing: they are each capable of independent rotation. Rotational control of the pulleys 204 and 204 is such that, by means of a control apparatus not shown in the drawing, they can be separately controlled in the same direction or in opposite directions and/or synchronously rotationally controlled with respect to the speed of rotation of either one of them. In this synchronized rotational control, in terms of the rotation ratio between the shafts 201 and 202, preset rotation ratios for each type of processing material and processing objective can be stored in specific storage means and selected at will. The bidirectional rotation ratio is such that the rotation of the main shaft 201 (rotor 4, described hereafter) is made slow and the rotation of the sub-shaft 202 (casing 3, described hereafter) is made fast, with target values of 1:5; and the unidirectional rotation ratio is such that the rotation of the main shaft 201 is made fast, and the rotation of the sub-shaft 202 is made slow, at target values of 4:1 to 18:1; and increases/decreases in speed of rotation over time, according to the different processing times for each processing material, are set as blocks (1 processing batch).

Meanwhile, at the other end of the sub-shaft 202, a cylindrical container 301 which constitutes the casing 3 is fitted by means of bolts 212 via a sleeve 211. Furthermore, at the other end of the main shaft 201, a rotor 4, which is provided within the container 301, is fitted so that the center thereof can be attached by means of a nut 209. The rotor 4 has a shape wherein a number of arms equal to the number of pressers 5 extend radially from the center thereof. The container 301 and the rotor 4 are rotatable in response to the rotation of the shafts 202 and 201 respectively. Reference numeral 207 indicates a bearing cover; and reference numeral 210 indicates a supply opening for the purpose of supplying the processing material supplied to the material supply tube 206 to the interior of the casing 3. Furthermore, the shaft seal gas G, which is supplied from the gas supply pipe 205, is evacuated to the exterior from the shaft seal 208 via a plurality of supply routes which pass through the main shaft 201 and the sleeve 213, which mates with the main shaft 201. Moreover, in terms of motors serving as a drive source, they may be separately positioned at the shafts 201 and 202 respectively, but it is a matter of course that the synchronous rotational control may be carried out with one motor.

The replaceable cylindrical inner wall 302 is fitted to the inner circumferential surface of the container 301 so that it can be fitted and removed freely. Reference numeral 303 indicates a retainer plate, and reference numeral 304 indicates a front cover: the retainer plate 303 has the purpose of forming a retainer against outflow of processing material from the container 301 in cases of batch processing wherein the front cover 304 is opened and the processing material is loaded into the container 301. The retainer plate 303 is a substantially disk shaped part having a circular opening in the center thereof, and is fixed in place by means of bolts 305, between the terminal opening of the container 301 and the front cover 304.

Reference numeral 306 indicates a high rotor joint fitted in a hole provided in the center of the front cover 304; in cases of continuous processing, the joint 306 serves to connect the rotating container 301 and a pipe (not shown in the drawing) connected thereto, so as to continuously evacuate the carrier gas, which is supplied to the interior of the container 301 from the gas supply pipe 205, together with the processed granular material (fine powder). Reference numeral 307 indicates an evacuation plug fitted in an opening provided at the periphery of the front cover 304; in cases where the processing material is batch processed, the evacuation plug 307 is such that, by removing it, the opening can be used as an evacuation opening. Moreover, the nut 209 is such that, in cases of continuous processing, one having a hole (the supply opening 210)is used and, in cases of batch processing, one without a hole is used.

Reference numeral 5 indicates a presser; the pressers 5 are equidistantly separated from each other at the ends of the arms of the rotor 4, equidistant from the axial center of main shaft 201, and advantageously 3 of these are supported in a cantilevered manner at one of their ends, the other of their ends being connected to and supported by a support plate 401, which is ring shaped and has a large opening in the center thereof. Thus, when the pressers 5 revolve in response to the rotation of the rotor 4, in accordance with the rotation of the main shaft 201, a horizontally oriented cylindrical region having an opening on the front cover 304 side is formed, and in this cylindrical region an empty region 6 is provided which is free of the presence of parts such as the extension of the shaft 201. In cases of batch processing, as described above, processing material is loaded into the empty region 6, by opening and closing the front cover 304. Furthermore, in cases of continuous processing, the supply opening 210, which is a supply route, and the high rotor joint 306, which is an evacuation route, are positioned on the axis of revolution of the pressers 5.

Each of the pressers 5 comprises a support axle 502 which is located parallel to and equidistant from the main shaft 201, 4 pulverizing rings 501 which are ring members and are equidistantly fitted so as to be able to rotate and to rock, and slide rings 503 which have diameters smaller than those of the pulverizing rings 501 and which serve to maintain gaps between each of the pulverizing rings 501; and in response to the rotation of the rotor 4, as a result of centrifugal force, the pulverizing rings 501 themselves rotate while contacting the surface of the cylindrical inner wall 302. Moreover, these pulverizing rings 501 are constituted so as to be able to rotate, but their constitution is not limited to this: they may have a non-rotating constitution, and may have any shape, such as a semicircular shape; briefly put, it is sufficient that the pressers 5 themselves are supported in free rotation or free rocking with respect to the rotor 4, and contact the surface of the cylindrical inner wall 302, so that processing material is trapped between them and the surface of inner wall 302 and (pulverization) energy can be applied to the processing material by the compressive force, shearing force, etc. of the pressers. Furthermore, the number etc. of the pressers 5 and the pulverizing rings 501 is not limited to that shown in the drawings, and it goes without saying that these may necessarily be increased or decreased according to the size of the apparatus.

FIG. 3 shows the configuration of the pulverizing rings 501. As described above, between the adjacently fitted rings 501, the sliding rings 503 are present, whereby they are separated by a gap just equal to 2 times the thickness of the pulverizing rings 501; and these are set so that, the pulverizing rings 501 of two of the pressers 5 are positioned in positions corresponding to the space between the adjacent pulverizing rings 501 of another presser 5. In other words, working from the pulverizing ring 501 positioned at the support plate 401 end of the presser 5 shown in FIG. 3(*a*) (the left end, in the drawing), the pulverizing ring 501 of the presser 5 shown in FIG. 3(*b*) is positioned in a position shifted therefrom by just the thickness of the pulverizing ring 501 and, similarly, the pulverizing ring 501 of presser 5 shown in FIG. 3(*c*) is positioned in a position shifted therefrom by 2 thicknesses of pulverizing ring 501; and when these revolve, the surface of the cylindrical inner wall 302 is pressed against in a phased distributed manner by the orbits of revolution of the pulverizing rings 501 of each of the pressers 5.

The constitution whereby the pulverizing rings 501 press in a distributed manner at this time is such that, for that surface region of the cylindrical inner wall 302 which is not pressed against by the revolution of the pulverizing rings 501 shown in FIG. 3(*a*), due the positions at which the pulverizing rings 501 shown in FIGS. 3(*b*) and (*c*) press, i.e. due to the combined successive pressing of the various rings 501 of each of the pressers 5, a continuous pressing region is formed, whereby there is no surface region against which a pulverizing ring 501 does not press, and positioning is such that all of the surface regions are pressed against by at least one of the pulverizing rings 501 in one rotation of the rotor 4. Accordingly, the thickness of pulverizing rings 501, and the gap between the adjacent pulverizing rings 501 is not limited to that shown in the drawings. Furthermore, in addition to that shown in the drawings herein, various shapes described in the Japanese Unexamined Patent Application Publication 6-79192 (U.S. Pat. No. 5,373,996) can be used for the shape of the pulverizing rings 501.

For the granular material processing apparatus 1 of the present embodiment, a type which is horizontally oriented is shown, but this may also be vertically positioned; in such a case, the end corresponding to the pulleys 203 and 204 is positioned downwards and the end corresponding to the casing 3 is positioned upwards. In such a case, it is preferable that such processes as smoothing the juncture between the retainer plate 303 and the inner wall 302 (the corner) be performed so that, when processing material is displaced in the direction of the cover 304, which is upwards, as the result of the centrifugal action of the pressers 5, this moves smoothly to the empty region 6.

In the mode of embodiment of the present invention having the constitution described, the processing material is supplied to the interior of the casing 3, but the casing 3 of the present invention is provided with the empty region 6, and supply of the processing material is to this empty region 6; and an apparatus 1 can be provided which is capable of, as a matter of course, batch processing, and also continuous processing, regardless of whether this is dry or wet processing.

In other words, in cases where the processing material is pulverized in a continuous manner, during operation, the processing material can be supplied in a continuous manner or a discontinuous manner, via the supply pipe 206 of the granular material processing apparatus 1, to the center of the empty region 6, where there is little influence from either the centrifugal force generated in accordance with the rotation of the pressers 5, or the swirl flow of the processing material, so that the processing material can be evenly supplied to the interior of the casing 3; and due to the centrifugal force of the pressers 5, this can be instantaneously and uniformly distributed to the entire surface of the inner wall 302. Furthermore, in cases of batch processing, the processing material may be loaded into the empty region 6 from the opening in the retainer plate 303, after removing the cover 304, so loading of the processing material is extremely easy; in particular, if the apparatus 1 is horizontally positioned, it is possible to load uniformly to the inner wall 302 and, after fitting the front cover 304, the loaded processing material is instantaneously and uniformly distributed to the entire surface of the cylindrical inner wall 302 as a result of the operation of the granular material processing apparatus 1 while, due to the revolution of the pressers 5 (stirring action) a swirl flow is generated along the surface of the cylindrical inner wall 302.

Processing material supplied in this manner is pulverized by the compressive force and shearing force of the pressers 5 which are pressed against the surface of the cylindrical inner wall 302 as a result of the centrifugal force caused by the rotation of the pressers 5. In other words, when the pressers 5 are rotated, the pulverizing rings 501 receive centrifugal force and rock to the periphery, the peripheral surface of the pulverizing rings 501 press against the cylindrical internal wall 302, and wile rocking slightly, they are rotated in a direction opposite to that of the rotation of the main shaft 201, along the inner wall 302. Consequently, the surface of the inner wall 302 and the pulverizing rings 501 rub against each other, and processing material is trapped between them; the processing material receives such pulverizing energy as the compressive force and shearing force of the pulverizing rings 501, and is pulverized. At this point, the empty region 6 is formed in the cylindrical region formed by the revolution of the pressers 5, and therefore, as the action of centrifugal force on fine powder which has been pulverized and made small is slight, it passes through the gaps between the adjacent pressers 5 and the gaps between the adjacent pulverizing rings 501, and moves to the empty region 6 wherein the influence of the revolution of the pressers 5 is slight. Accordingly, within the casing 3, as a result of the combined actions of the swirl flow of processing material generated in response to the revolution of the pressers 5 and the differences in centrifugal force acting on each piece of processing material (individual particles) depending on the degree of processing of the pieces of processing material, good circulatory flow conditions, wherein a center forms, are maintained for the processing material; and an optimal circulation environment is made possible wherein a balance is achieved between even distribution of processing material and even application of pulverizing energy, allowing the pulverizing energy of the pulverizing rings 501 to be uniformly applied to the processing material. Consequently, the cylindrical region can be put to effective use and, even in cases where, for example, the apparatus 1 is positioned vertically and processing is performed by the revolution of the pressers 5 alone, even if the processing material is acted upon by the centrifugal force which it is caused have by the revolution of the pressers 5 and displaced upwards in the direction of the front cover 304, the processing material does not accumulate in once place within the casing 3, but moves smoothly to the empty region 6, and can be repeatedly moved in an evenly distributed manner to the entire surface of the casing inner wall 302, the pulverizing energy of the pulverizing rings 501 can repeatedly be evenly applied to the processing material, the movement of the processing material is controlled in an evenly distributed optimal stable state, and an optimized environment can be produced within the casing 3.

Rotational control methods will be described for cases where the granular material processing apparatus 1 is operated so that in addition to the turning of the rotor 4, the casing 3 is caused to turn. In these cases, in addition to an optimized environment within the casing 3 where a balance is achieved between the even distribution of processing material and even application of pulverizing energy thereto, it receives the combined action of the centrifugal force caused by the turning of the casing 3.

In cases where the turning of the rotor 4 and the turning of the casing 3 are rotationally controlled in the same direction at different speeds of rotation, while this may vary according to the physical properties of the processing material and the processing objective, for example, the speed of rotation of the casing 3 is set within the range of 0.5 m/sec. to 1.5 m/sec., and the speed of rotation of the rotor 4 is set within the range of 1.5 m/sec. to 25 m/sec., and rotational control is performed with the speed of rotation of the rotor 4 set faster than the speed of rotation of the casing 3.

Consequently, as well as being acted on by the centrifugal force of the rotor 4, the processing material also receives the centrifugal force of the casing 3. Accordingly, it is not necessary to unduly increase the rpm of the rotor 4 solely in order to control the movement (to improve the movement) of the processing material. Furthermore, as the processing material receives rotational movement in the same direction, when it is trapped between the surface of the inner wall 302 and the pulverizing rings 501, disruption and turbulence in the processing material, or large quantities of air bubbles can be prevented, wear can be reduced, and an environment can easily be maintained wherein pulverizing energy resulting from compressive force, shearing force etc. can be applied as even pressing. Moreover, by mounting the granular material processing apparatus 1 horizontally, the movement of the processing material can be controlled in a further optimized stable state and, as well as repeatedly applying the pulverizing energy of the pulverizing rings 501 in an even more evenly distributed manner, particularly in cases where powders with a low specific gravity, or small processing quantities of granular materials, are wet processed, the processing material does not accumulate in one place within the casing 3.

In cases where the granular material processing apparatus 1 is operated according to a method wherein the turning of the casing 3 and the turning of the rotor 4 are rotationally controlled in opposite directions at differing speeds of rotation, as opposed to that described above, these are rotationally controlled so that the speed of rotation of the casing 3 is set faster than that of the rotor 4. In such cases, it is desirable that the speed of rotation of the rotor 4 is controlled to rotate at a lower speed than it would when the casing 3 does not rotate. By these means, application of excessive pulverizing energy to the processing material, disturbances in the swirl flow of the processing material, and such problems which arise when the speed of rotation is too great can be eliminated, and circulatory flow conditions can be maintained.

Rotational control of the casing 3 and the rotor 4 in the same direction or in opposite directions, as described above, is such that, in addition to operations which turn the casing 3 and the rotor 4 at predetermined corresponding ratios, the rotations of both are determined by rotational control wherein both rotations are synchronized; furthermore, these rotation ratios, which correspond to the physical properties of various types of processing materials and processing objectives, are stored by specific storage means. For example, in cases where batch processing is performed continuously, a series of steps can be stored wherein, in the processing material loading step, the speed of rotation of the casing 3 and the rotor 4 can be increased as desired (i.e. relative speed=0); in the processing stage, after varying the speed of rotation of the rotor 4 as desired, the two are synchronized and rotation speed is increased or decreased; and in the evacuation stage, the casing 3 is slowed or is stopped and, while rotating the rotor 4 (at low speed), evacuation is performed, as required, by suction from the high rotor joint 306. Thus, these settings may be freely chosen amongst, not only for the pulverization of a granular material, but also for mixing pulverization and even dispersion of two or more different granular materials, for mixing dispersion of a granular material and a liquid, and for various processing operations of various granular materials, including the even dispersion processing of pigments and such slurry substances as paints, etc., preventing operational errors, and allowing for stable and effective preparation of products.

The arrangement of the pulverizing rings 501 which constitute each of the pressers 5, is such that the orbits of revolution of the pulverizing rings 501 on one presser 5 and those of the pulverizing rings of the other pressers 5 each press against the inner wall 302 in a phased distributed manner and, therefore, as described above, the processing material (fine powder which has been pulverized and reduced in size) passes through the gaps between the adjacent pressers 5 and the gaps between the adjacent pulverizing rings 501, and can move smoothly to the empty region 6 where the influence of the revolution of the pressers 5 is slight. Moreover, the constitution wherein the orbits of revolution of each of the pulverizing rings 501 press in a distributed phased manner is such that, due to the combined pressing at the surface regions against which the pulverization rings 501 of one of the pressers 5 press, and at the surface regions against which the pulverizing rings of the other pressers 5 press, a continuous pressing region is formed over the inner wall 302. In other words, that inner wall surface 302 which is not pressed by the pulverizing rings 501 of one presser 5 is always pressed by the pulverizing rings of another presser 5. Accordingly, the orbit of revolution of the pulverizing rings 501 shown in FIG. 3(*a*), the orbit of revolution of the pulverizing rings shown in FIG. 3(*b*), and the orbit of revolution of the pulverizing rings shown in FIG. 3(*c*) press efficiently without overlapping each other; and the entire area of the cylindrical inner wall 3 is pressed against by the pulverizing rings 501, just as if all of these pressing rings 501 were mounted in close contact with each other on one support axle 502. Furthermore, as the processing material can move to the empty region 6 from between each of the pulverizing rings 501, in the case of vertical type equipment, as the processing material is caused to revolve in the container 3, it is not necessary to set the speed of rotation of the rotor 4 to a special speed to move the processing material upwards, and pulverizing energy can be efficiently applied to the processing material in the casing 3.

Furthermore, a constitution may be used wherein the number of the pulverizing rings 501 on each presser 5 is 1, and the orbits of revolution of these press in a phased, distributed manner, or the thickness and positioning gaps of the pulverizing rings 501 on one presser 5 may differ from each other; and the number of pressers 5 may also be freely chosen.

In cases of continuous processing, granular materials processed in this manner are evacuated via the high rotor joint 306, and in cases of batch processing, they may be evacuated after removing the evacuation plug 307 (evacuation opening).

In cases of continuous dry pulverization, carrier gas is continuously supplied to the empty region 6 from the supply opening 201 via the gas supply pipe 205, and while the carrier gas forms a swirl flow (vortex) within the empty region 6 in response to the revolution of the pressers 5, it moves in the direction of the rotational axis (in the direction of the front cover 304), and is evacuated to the exterior of the system via the high rotor joint 306 and the pipe which is connected thereto. The fine particles which have been pulverized and moved to the empty region 6 are evacuated to the exterior of the system together with the vortex of carrier gas, and are separated from the carrier gas by means of a gas/solid separation apparatus such as a bag filter (not shown in the drawing) which is connected to the tube, and recovered. Furthermore, suction means may be connected as necessary.

In cases of batch processing, with the rotation of the casing 3 stopped, by causing the rotor 4 alone to rotate at a low speed of approximately 2 m/sec., the processing material in the casing 3 is automatically evacuated. In some cases, depending of the physical properties of the processed processing material, it may be difficult to evacuate it at this point; in such cases, it may be evacuated by suction from the exterior, or it may be scraped out after removing the front cover 304 and the retainer plate 303.

In the present invention, by forming the empty region 6 wherein there is no extension of the shaft 201 etc., in the cylindrical region formed in accordance with the revolution of the pressers 5, which allows for the formation of a center of swirl flow of the granular material in the cylindrical region, due to the combined action of the centrifugal force of pressers 5 and that of maintaining good circulation conditions for the swirl flow within the casing 3, the movement of the granular material can be controlled and, moreover, not only batch processing, but also continuous processing can be performed easily.

Furthermore, the casing 3 may also be rotatable, and by allowing rotational control of both the turning of the casing 3 and the turning of the rotor 4 at differing speeds in the same direction, the effects of the centrifugal forces of the pressers 5 and the casing 3 can be adjusted separately, and the movement of the granular material in the casing 3 can be controlled as a swirl flow having good unidirectional circulation.

Furthermore, by orienting such a granular material processing apparatus 1 horizontally and supporting the pressers 5 on the rotor 4 in a cantilevered manner, a horizontally oriented cylindrical region is formed in accordance with the revolution of the pressers 5, the granular material can be evenly distributed to the surface of the casing inner wall 302, and the centrifugal action of the pressers 5 can be applied thereto; moreover, effective use can be made of the cylindrical region formed in accordance with the revolution of the pressers 5, by forming the empty region 6.

Accordingly, even in cases where granular materials for which it is difficult to control the motion thereof within the casing 3 are dry processed or wet processed, the granular material does not accumulate in one place within the casing 3, but is moved to the entire inner wall of the casing 3, and centrifugal force can be evenly applied as such energy as the compressive force and shearing force of the pressers 5, and processing under good conditions is possible, whereby the motion of the granular material is controlled, and optimal stable control is obtained which achieves a balance between even distribution of the granular material and even application of such energy as the compressive force and shearing force of the pressers 5, whereby is it possible to optimize the environment within the casing 6.

INDUSTRIAL APPLICABILITY

By virtue of the present invention, granular material is moved to the entire inner wall of the casing without accumulating in one place within the casing, and such energy as the compressive force and shearing force of the pressers due to centrifugal force can be evenly applied, and this can be used in cases of both dry processing and wet processing of granular materials.

The embodiments of the invention in which an exclusive property or privilege is claimed are defined as follows:

1. A granular material processing apparatus comprising:

a rotor coupled to a first shaft provided in a casing having an inner wall which forms a granular material processing chamber;

a plurality of pressers supported at the edge of said rotor, said pressers being separated from each other by a predetermined gap;

wherein said pressers are caused to revolve in cooperation with the turning of said rotor and press against the inner wall of the casing to process granular material; and wherein in a cylindrical region defined in accordance with the revolution of said pressers, an empty region is formed devoid of the first shaft rotor and other components thereby making it possible for a center of swirl flow of said granular material to be formed within said cylindrical region.

2. The granular material processing apparatus of claim 1, wherein said casing is coupled to a second shaft and rotatable therewith, allowing for separate rotational control of the turning of said casing and the turning of said rotor.

3. The granular material processing apparatus of claim 2, wherein said casing and said rotor can be rotated in the same and opposite directions at differing speeds.

4. The granular material processing apparatus of claim 3, wherein with the casing and rotor rotating in the same direction, said rotor rotates faster than the rotational speed of the casing, and wherein when the casing and rotor rotating in opposite directions, the rotational speed of said casing is faster than the rotational speed of said rotor.

5. The granular material processing apparatus of claim 2, wherein said rotational control allows for synchronous rotation of said casing and said rotor at predetermined corresponding ratios.

6. The granular material processing apparatus of claim 5, wherein:

said rotational control is configured such that a plurality of corresponding ratios of rotation for said casing and said rotor are preset; and said rotational control comprises a memory system which stores said ratio settings; and, specific ratio settings can be chosen which correspond to the granular material to be processed.

7. The granular material processing apparatus of claim 2, wherein:

said rotational control is configured such that a plurality of corresponding ratios of rotation for said casing and said rotor are preset; and said rotational control comprises a memory system which stores ratio settings; and specific ratios in that settings can be chosen which correspond to the granular material to be processed.

8. The granular material processing apparatus of claim 1, wherein granular material is supplied to and removed from the granular material processing chamber by way of a supply route provided on said rotor side of the casing and an evacuation route provided on the side of the casing which faces said rotor, so that supply and removal of the granular material can be carried out continuously, and so that the granular material is supplied to the empty region of the casing.

9. The granular material processing apparatus of claim 8, wherein the supply route and evacuation route are positioned on the axis of revolution of said pressers.

10. The granular material processing apparatus of claim 9, wherein a casing port is located on the side of the casing facing said rotor for the supply and evacuation of said granular material, it is possible to open and close said casing port, and by opening and closing said casing port, granular material is supplied to said empty region of the casing and evacuation of granular material from the casing is carried out by way of an evacuation opening provided at this casing port.

11. The granular material processing apparatus of claim 1, wherein said plurality of pressers comprising support shafts supported by said rotor and rings fitted on said support shafts so as to press against the inner wall of said casing, said rings are arranged so that the orbits of revolution of the rings on one presser and those of the rings on other pressers each press against the inner wall of the casing in a phased, distributed manner.

12. The granular material processing apparatus of claim 11, wherein the distributed pressing of said rings is such that due to combined pressing on regions pressed by the rings of one presser and regions pressed by the rings of other pressers, a continuous pressing region is formed over the casing inner wall.

13. The granular material processing apparatus of claim 1, characterized in that said processing apparatus is positioned vertically with said rotor end being the lower end and said casing wall end, which faces said rotor, being the upper end.

14. A granular material processing apparatus, comprising:

a casing forming a granular material processing chamber, said casing coupled to a first shaft for rotation of the casing;

a rotor provided within said casing, said rotor coupled to a second shaft for rotation of the rotor;

a plurality of pressers supported at the edge of said rotor to extend therefrom along the axis of rotation of the rotor, said pressers being separated from each other by a predetermined gap, and said pressers are caused to revolve in cooperation with the turning of said rotor and to press against the inner wall of the casing to process the granular material; wherein said first and second shafts are rotatable independently of each other for rotation of said casing and the rotor at differing selected speeds of rotation.

15. The granular material processing apparatus of claim 14, wherein, the rotor is rotated at faster speed than the rotational speed of said casing.

16. The granular material processing apparatus of claim 15, wherein a cylindrical region is formed in accordance with the revolution of said pressers.

17. The granular material processing apparatus of claim 16, wherein, in said cylindrical region, an empty region devoid of said shaft and other apparatus components is formed, making possible the formation of a center of swirl flow of said granular material within said cylindrical region.

18. The granular material processing apparatus of claim 14, wherein a cylindrical region is formed in accordance with the revolution of said pressers.

19. The granular material processing apparatus of claim 14, wherein the first and second shafts are rotatable, for synchronous rotation of said casing and said rotor at predetermined corresponding ratios.

20. The granular material processing apparatus of claim 19, wherein:

a plurality of ratios of rotation for said casing and said rotor are preset; and, ratio settings can be chosen which correspond to the granular material to be processed.

21. The granular material processing apparatus of claim 14, wherein granular material is supplied to and removed from the granular material processing chamber by way of a supply route provided on said rotor side of the casing and an evacuation route provided on the side of the casing which faces said rotor, so that supply and removal of the granular material can be carried out continuously, and so that the granular material is supplied to a cylindrical region of the casing formed in accordance with the revolution of said pressers.

22. The granular material processing apparatus of claim 21, wherein the supply route and evacuation route are positioned on the axis of revolution of said pressers.

23. The granular material processing apparatus of claim 22, wherein a casing port is located on the side of the casing for the supply and evacuation of said granular material, it is possible to open and close said casing port and evacuation of granular material from the casing is carried out by way of an evacuation opening provided at this casing port.

24. The granular material processing apparatus of claim 14, wherein said plurality of pressers comprising support shafts supported by said rotor and rings fitted on said support shafts so as to press against the inner wall of said casing, said rings are arranged so that the orbits of revolution of the rings on one presser and those of the rings on other pressers each press against the inner wall of the casing in a phased, distributed manner.

25. The granular material processing apparatus of a claim 24, wherein the distributed pressing of said rings is such that due to combined pressing on regions pressed by the rings of one presser and regions pressed by the rings of other pressers, a continuous pressing region is formed over the casing inner wall.

26. The granular material processing apparatus of claim 14, characterized in that said processing apparatus is positioned vertically with said rotor end being the lower end and said casing wall end, which faces said rotor, being the upper end.

27. A granular material processing apparatus, comprising:

a casing forming a granular material processing chamber;

a rotor provided within said casing;

first and second rotatable shafts coupled to the casing and rotor, respectively;

a plurality of pressers supported at the edge of said rotor, said pressers being separated from each other by a predetermined gap, and said pressers are caused to revolve in cooperation with the turning of said rotor and to press against the inner wall of the casing to process the granular material; wherein said pressers being supported in a cantilevered manner on said rotor so that the axis of rotation of said apparatus is horizontally oriented, and a horizontally oriented cylindrical region is formed in accordance with the revolution of said pressers.

28. The granular material processing apparatus of claim 27, wherein said casing and said rotor can be rotated in the same and opposite directions at differing speeds.

29. The granular material processing apparatus of claim 28, wherein with the casing and rotor rotating in the same direction, said rotor rotates faster than the rotational speed of the casing, and wherein the casing and rotor rotating in opposite directions the rotational speed of said casing is faster than the rotational speed of said rotor.

30. The granular material processing apparatus of claim 27, characterized in that said rotational control allows for synchronous rotation of said casing and said rotor at predetermined corresponding ratios.

31. The granular material processing apparatus of claim 30, wherein:

said rotational control is configured such that a plurality of corresponding ratios of rotation for said casing and said rotor are preset;

said rotational control comprises a memory system which stores said ratio settings; and, specific ratio settings can be chosen which correspond to the granular material be processed.

32. The granular material processing apparatus of claim 27, wherein, in said cylindrical region, an empty region wherein there is no extension of said shaft or other components of the granular material processing apparatus is formed, making possible the formation of a center of swirl flow of said granular material within said cylindrical region.

33. The granular material processing apparatus of claim 27, wherein material is supplied to and removed from the granular material processing chamber by way of a supply route provided on said rotor side of the casing and an evacuation route provided on the side of the casing which faces said rotor, so that supply and removal of the granular material can be carried out continuously, and so that the granular material is supplied to the cylindrical region of the casing.

34. The granular material processing apparatus of claim 33, wherein the supply route and evacuation route are positioned on the axis of revolution of said pressers.

35. The granular material processing apparatus of claim 34, wherein a casing port is located on the side of the casing facing said rotor for the supply and evacuation of said granular material, it is possible to open and close said casing port, and by opening and closing said casing port, granular material is supplied to said cylindrical region of the casing and evacuation of granular material from the casing is carried out by way of an evacuation opening provided at this casing port.

36. The granular material processing apparatus of claim 27, wherein said plurality of pressers comprising support shafts supported by said rotor and rings fitted on said support shafts so as to press against the inner wall of said casing, said rings are arranged so that the orbits of revolution of the rings on one presser and those of the rings on other pressers each press against the inner wall of the casing in a phased, distributed manner.

37. The granular material processing apparatus of claim 36, wherein the distributed pressing of said rings is such that due to combined pressing on regions pressed by the rings of one presser and regions pressed by the rings of other pressers, a continuous pressing region is formed over the casing inner wall.

38. The granular material processing apparatus of claim 27, characterized in that said processing apparatus is positioned vertically with said rotor end being the lower end and said casing wall end, which faces said rotor, being the upper end.

* * * * *

UNITED STATES PATENT AND TRADEMARK OFFICE

CERTIFICATE OF CORRECTION

PATENT NO. : 6,454,194 B1
DATED : September 24, 2002
INVENTOR(S) : K. Hamada et al.

It is certified that error appears in the above-identified patent and that said Letters Patent is hereby corrected as shown below:

Title page,
Item [30], Foreign Application Priority Data, insert in appropriate order:
-- Feb. 18, 2000 (PCT) PCT/JP00/00919 --
Item [57], ABSTRACT,
Line 8, "in once" should read -- in one --

Column 11,
Line 5, "in that settings" should read -- in said settings --

Column 12,
Line 18, "ratio settings can be" should read -- specific ratio settings can be --

Signed and Sealed this

Twenty-second Day of July, 2003

JAMES E. ROGAN
*Director of the United States Patent and Trademark Office*